US012319477B2

(12) United States Patent
Ng

(10) Patent No.: US 12,319,477 B2
(45) Date of Patent: Jun. 3, 2025

(54) LOCKING SYSTEM FOR FLEXIBLE BOX

(71) Applicant: Tsing Kou Ng, Hayward, CA (US)

(72) Inventor: Tsing Kou Ng, Hayward, CA (US)

( * ) Notice: Subject to any disclaimer, the term of this patent is extended or adjusted under 35 U.S.C. 154(b) by 148 days.

(21) Appl. No.: 18/215,082

(22) Filed: Jun. 27, 2023

(65) Prior Publication Data

US 2025/0002204 A1 Jan. 2, 2025

(51) Int. Cl.
*B65D 5/20* (2006.01)
*B65D 5/54* (2006.01)

(52) U.S. Cl.
CPC ..... *B65D 5/2057* (2013.01); *B65D 5/54* (2013.01)

(58) Field of Classification Search
CPC ..... B65D 5/2057; B65D 5/54; B65D 2571/0066; B65D 2571/0016; B65D 2571/00277; B65D 2571/00172; B65D 2571/00265; B65D 71/18; B65D 5/4279; B65D 2571/00154; B65D 33/243
USPC ..... 229/155, 198.2, 185, 158; 206/427, 140
See application file for complete search history.

(56) References Cited

U.S. PATENT DOCUMENTS 4,526,316 A * 7/1985 Sutherland ..... B65D 71/14 206/157
4,600,140 A * 7/1986 Milliens ..... B65D 71/12 206/427
4,723,699 A * 2/1988 Brown ..... B65D 5/4279 229/185
5,002,225 A * 3/1991 Bienaime ..... B65D 71/18 229/198.2
2022/0017263 A1* 1/2022 Wikstrom ..... B65D 5/546

* cited by examiner

*Primary Examiner* — Christopher R Demeree
(74) *Attorney, Agent, or Firm* — FULWIDER PATTON LLP

(57) ABSTRACT

A lockable container comprises an upper flap and a lower flap. The upper flap has a slot that also defines a tab. The lower flap has a securing structure that is partially insertable into the slot. The tab is flexibly moveable between a first position in which the tab is outside of the lower flap, and a second position in which the tab is inside of the lower flap, whereby when the tab is moved into the second position the securing structure is prevented from moving leftward by a left closed end of the slot and the securing structure is simultaneously prevented from moving rightward by the tab.

2 Claims, 6 Drawing Sheets

LOCKING SYSTEM FOR FLEXIBLE BOX

FIELD OF THE INVENTION

The present invention relates to a system and method for a locking system to close a flexible box or receptacle.

BACKGROUND

As used herein, the directional terms "up, down, left, right, vertical, and horizontal," are made using the orientation of the top surface of the boxes in FIGS. 2-10 as a reference. The terms "in" and "out" are used with reference to the plane of the figures, with "in" meaning into the sheet containing the figures, and "out" meaning out of the sheet towards the viewer.

Foldable boxes and containers are well known in the art for containing many types of material. Food, in particular, is a beneficiary of this art, allowing fast food services to pack a suitable amount of food into a foldable box, typically made of cardboard or similar flexible and inexpensive material. FIG. 1 shows a typical foldable box 10 known in the prior art. Typically, the box may be formed from a single piece of cardboard that is stamped out or cut from a sheet. The box when folded appropriately will have vertical sidewalls 16; a base (not shown in FIG. 1); opposing left flap 18, and right flap 20; and opposing connectable flaps, lower flap 12, and upper flap 14. A securing system 22 is typically provided to attach the opposing flaps 12, 14 to each other in such a manner that a user of the box can keep the box closed during transportation, but open the box again once it is desired to gain access to the contents of the box.

A typical known securing system may be described with reference to FIGS. 2-4. FIG. 2 shows, in further detail from FIG. 1, the opposing intermediate flaps 18 and 20, which assist in sealing off the box when secured. An upper flap 14 is shown—without the opposing lower flap 12 in FIG. 2 for clarity at this stage. Upper flap 14 typically has a slot 24 cut through it which, in this case, runs in a horizontal straight line from left to right in a middle portion 24*a* of the slot, which curves downwardly at a left hand end portion 24*b* of the slot, and which curves upwardly at a right hand portion 24*c* of the slot.

As will be seen in FIGS. 3-4, this shape is suitable for receiving a clasping structure 26 formed on an upper edge of the lower flap 12.

It will be noted in FIGS. 1, and 3-4 that dashed lines are used to more clearly show the prior art structure. In FIG. 3, the dashed lines show the structure of a slot 24 on upper flap 14, that lies inside flap 12 as shown and which would otherwise be invisible in this view. The dashed lines are used to clarify the configuration of the structure as shown. Similarly, in FIGS. 1, 3, and 4, dashed lines show the structure of portion of flap 12 that lies inside upper flap 14 and which would otherwise be invisible in this view.

The clasping structure 26 in this embodiment of the prior art (shown in FIG. 3) is shaped, in a side outline, as an imaginary clasping right hand, with fingers 30 extending to the left, a horizontal gap 28 between the fingers and the hand 34, and knuckles 32 occupying the uppermost edge of the flap 12. The gap 28 in this embodiment defines a vertical portion 29 located at the right side end of the gap.

The shape of the clasping structure 26 is suitable for inserting into the slot 24 of the upper flap 14, in the manner shown in FIG. 4. The user slides the knuckle 32 of the clasping structure on the lower flap 12 upwardly and leftwardly into the slot 24 of the upper flap 14 so that the gap 28 on the lower flap 12 receives the downwardly extending portion 24*b* of the slot 24 in an opposing relationship, in which the downwardly extending portion 24*b* of the slot butts up against the vertical portion 29 of the gap 28. It will be evident that in this condition, the clasping structure 26 cannot be moved to the left in relation to the upper flap 14, and the clasping structure 26 cannot be pulled vertically downward in relation to the upper flap. This condition will be called the clasping condition.

However, it will also be apparent that the clasping structure 26 can first be moved rightwards and, thereafter, downward in relation to the upper flap 14, in an opposite motion to that which allowed the clasping structure to be inserted into the slot 24 to achieve the clasping condition. This ability to simply move the clasping structure in a reverse motion to undo the clasping condition presents a problem in the prior art, because it frequently occurs that a box may be inadvertently squeezed in a shearing force action (leftward force on the top side, rightward force on the bottom side of the box) with the result that the clasping structure 26 is disengaged from the slot 24 and all the flaps are free to fly open, with unfortunate results for the contents of the box.

The presently described invention is a novel system and method that addresses these and other needs in the art.

SUMMARY OF THE INVENTION

In one embodiment the invention is a lockable container. The embodiment comprises a receptacle with an upper flap flexibly connected to the receptacle by a first hinge. A lower flap is flexibly connected to the receptacle by a second hinge. The upper flap defines a slot that is shaped to include a generally horizontally extending portion of the slot having a left closed end of the slot and a right closed end of the slot. A tab is formed that is cantilevered and formed at the right closed end of the slot, the tab extending downwardly and configured to be flexibly moveable inwardly toward an interior of the receptacle and, alternatively, outwardly toward an exterior of the receptacle. The lower flap defines a securing structure that is sized to be inserted into the slot. The securing structure has a generally horizontally extending gap, the gap having a left open end and a right closed end, the right closed end of the gap being configured to opposingly engage with the left closed end of the slot when the securing structure is inserted into the slot. This arrangement gives rise to a configuration wherein, adjacent to and above the gap, the upper flap is positioned outside of the lower flap. Further, adjacent to and below the gap, the upper flap is positioned inside of the lower flap. The tab is flexibly moveable between a first position in which the tab is outside of the lower flap, and a second position in which the tab is inside of the lower flap, whereby when the tab is moved into the second position the securing structure is prevented from moving leftward by the left closed end of the slot and the securing structure is simultaneously prevented from moving rightward by the tab.

In some embodiments the tab is configured in relation to the lower flap to be flexibly moveable from the first position to the second position by a force applied to the tab in a direction toward the interior of the receptacle.

In yet further embodiments, a perforation is formed in the upper flap, the perforation extending from the slot to an edge of the upper flap, whereby the tab may be removed from the upper flap by tearing along the perforation.

DETAILED DESCRIPTION OF THE DRAWINGS

DETAILED DESCRIPTION OF THE PREFERRED EMBODIMENTS

Figure 1:
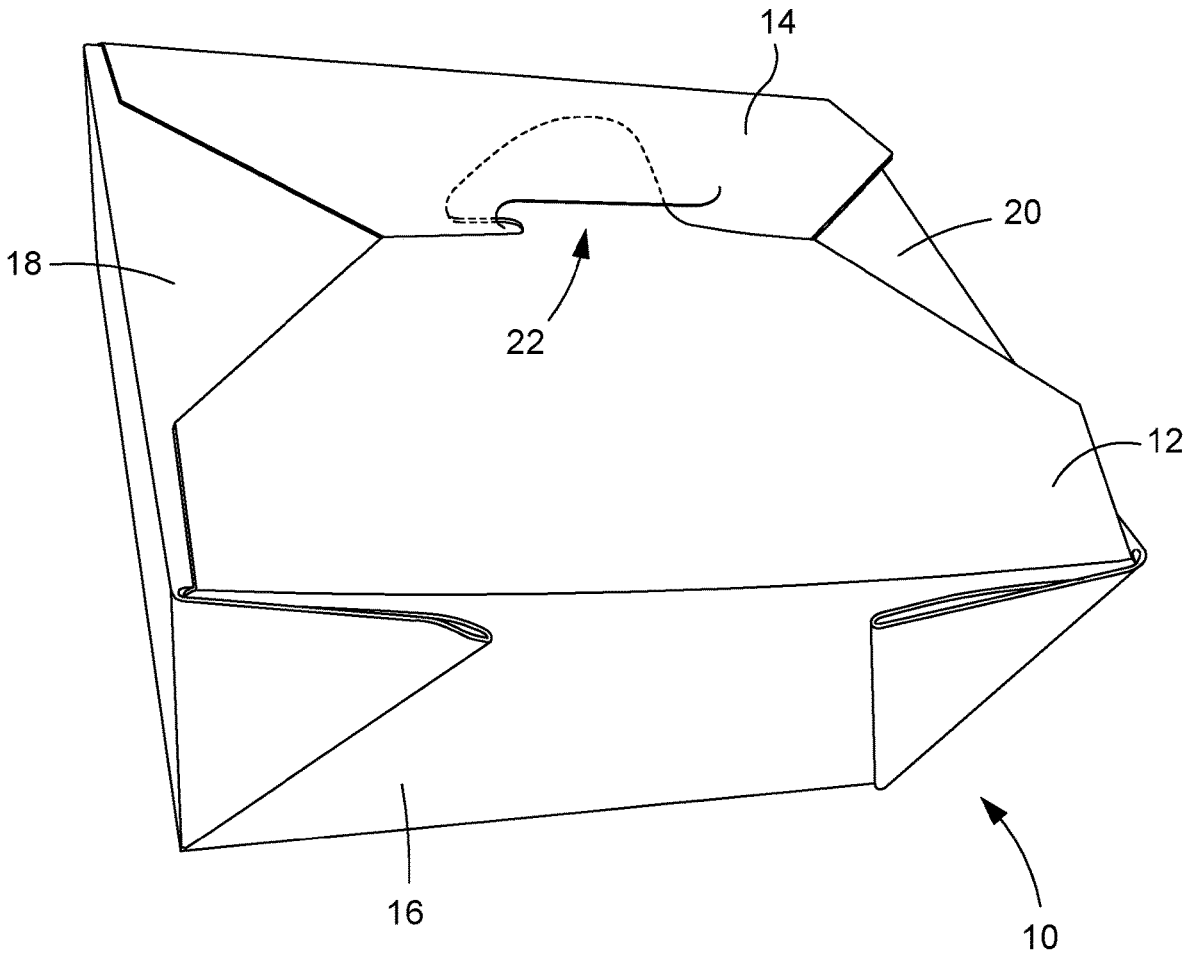
FIG. 1 PRIOR ART
FIG. 1 shows a box, known in the prior art, which has folding flaps to close the box in a secured condition.
Figure 2:
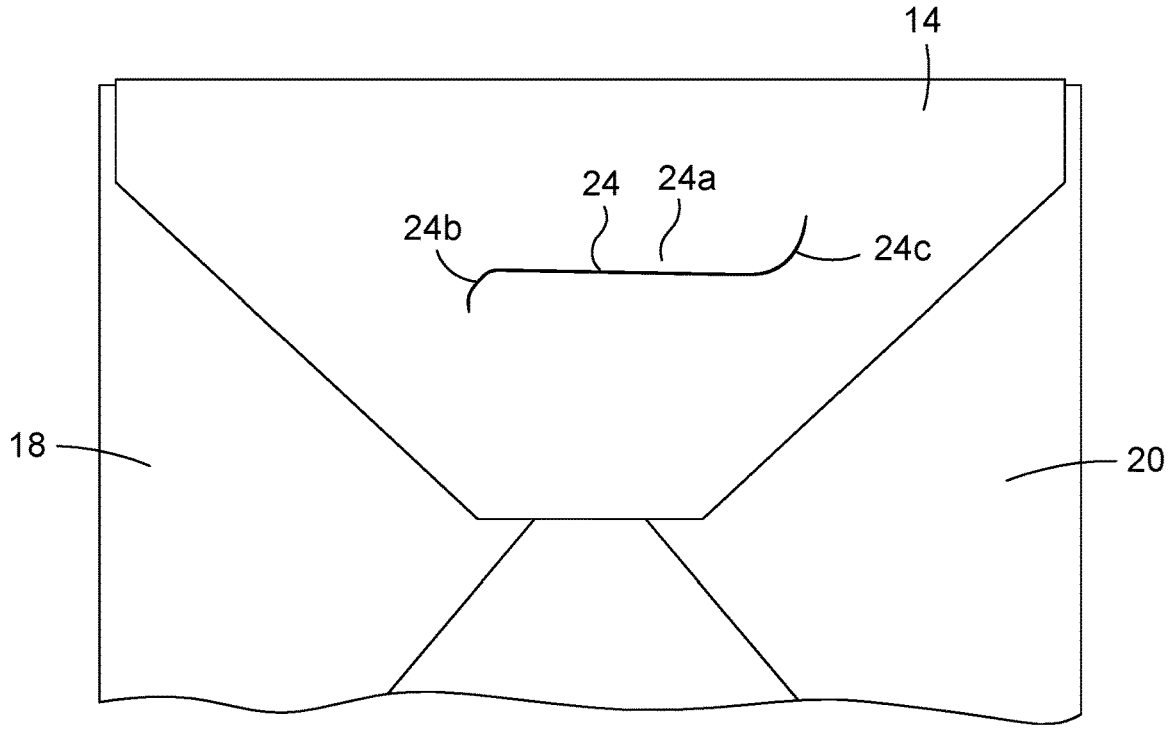
FIG. 2 PRIOR ART
FIG. 2 shows a detail of the box in FIG. 1, of a first condition of how a securing structure may operate in the prior art.
Figure 3:
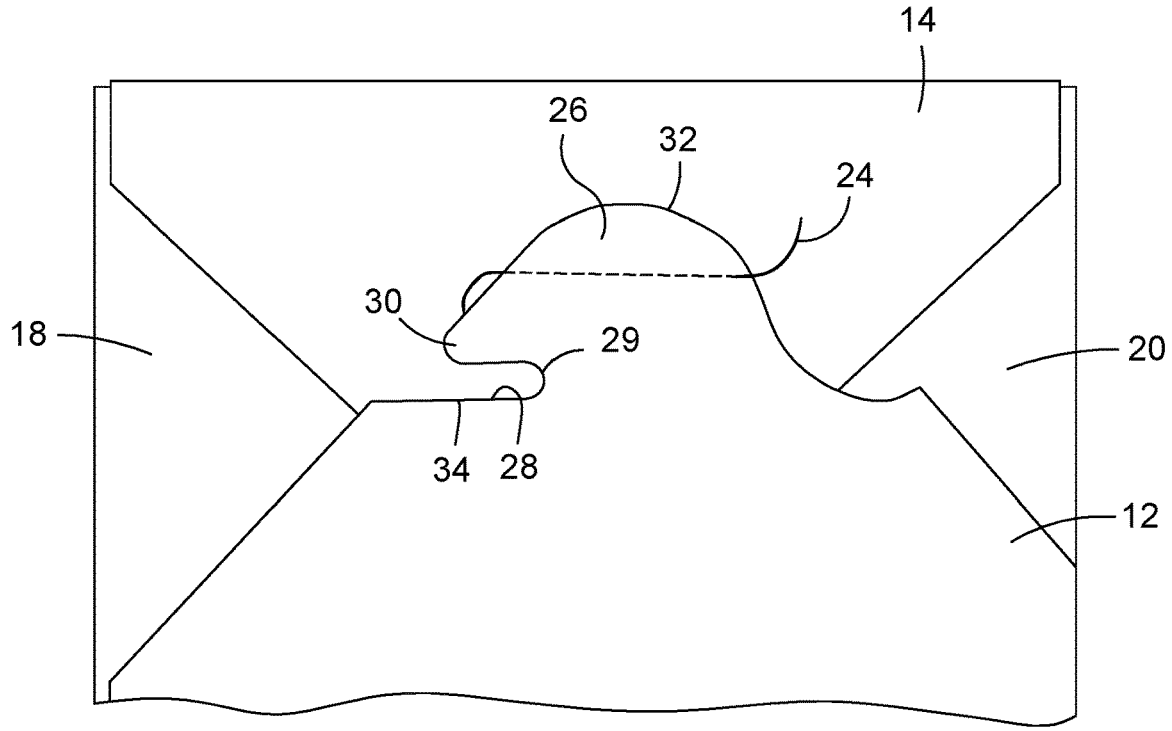
FIG. 3 PRIOR ART
FIG. 3 shows another detail of the box in FIG. 1, of a second condition of how a securing structure may operate in the prior art.
Figure 4:
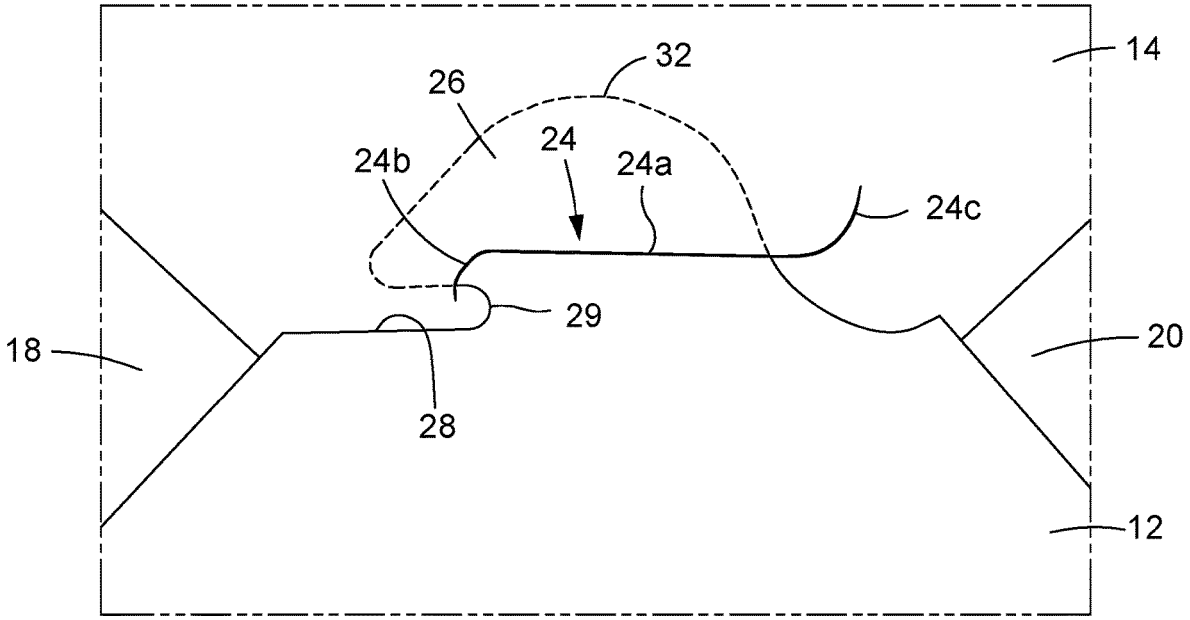
FIG. 4 PRIOR ART
FIG. 4 shows another detail of the box in FIG. 1, of a third condition of how a securing structure may operate in the prior art.

In the following detailed description, certain preferred embodiments are described in order to provide a thorough understanding of the present invention.

When describing the invention, if a feature of an embodiment is the same as a corresponding feature described in the prior art above, then the same reference numeral will be used as has been used above in the prior art. When a feature of the inventive embodiment is different or not disclosed in the prior art, then the reference numerals used will exceed 100.

In one embodiment the invention comprises a configuration based on a flexible box or receptacle that has opposing left and right flaps 18, 20, such as in the general type of box described with reference to FIGS. 1-4. The inventive embodiment also has a securing structure 26 on the lower flap 12, just as in FIGS. 1-4. The inventive structure has an upper flap 114 that differs from the upper flap of the prior art, in that, in the embodiment of the invention shown in FIGS. 5-10, a slot in the upper flap 114 has a novel and different shape, and type of slot 124 is provided. As will be explained, this shape will allow the lower flap 12 and the upper flap 114 to be in a locking connection with each other that is substantially restrained against easy accidental disconnection.

Figure 5:
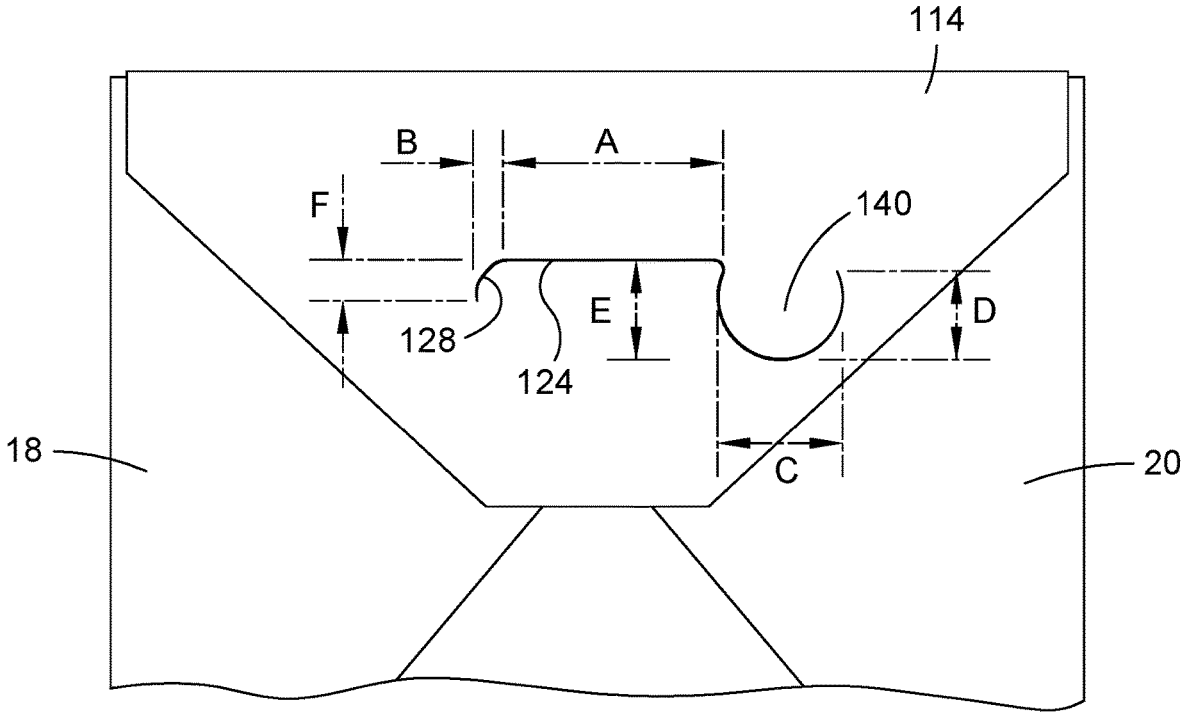
FIG. 5 shows a configuration of a first condition of how an embodiment of a locking structure of the invention may operate.

With reference to FIG. 5, in order to achieve the above stated result, a slot 124 is provided in an upper flap 114. The shape of the slot 124 is described here using alphabetic letters in relation to and to identify specific portions of the shape of the slot 124. The portion which is identified as "A" is a generally linear portion of about 1 inch in length, extending horizontally from left to right. The portion of the slot which is identified as "B" (horizontally) and "F" (vertically) is a generally downwardly curved portion in which both "B" and "F" are about 0.2 inches long. This downwardly curved portion 128 of the slot is a continuation of a left end of portion "A" of the slot and its function is to prevent the securing structure 26 from moving in a leftwards direction in relation to the upper flap 114. At the right end of portion "A" is a curved portion of the slot 124 that follows a curved path, starting at the right end of portion A, then following a path extending downwardly for about 0.5 inches (as portion "E") then rightwards for about 0.5 inches (as portion "C") then vertically for about 0.5 inches (as portion "D"). The shape of slot portions E, C and D may be curved, as shown in FIG. 5, or the sides may be straight. The purpose of portions E, C, D is to provide a downwardly extending cantilevered tab 140 on the right hand end of the slot 124. The functional purpose of the cantilevered tab 140 is described with reference to FIGS. 6-10 below.

Figure 6:
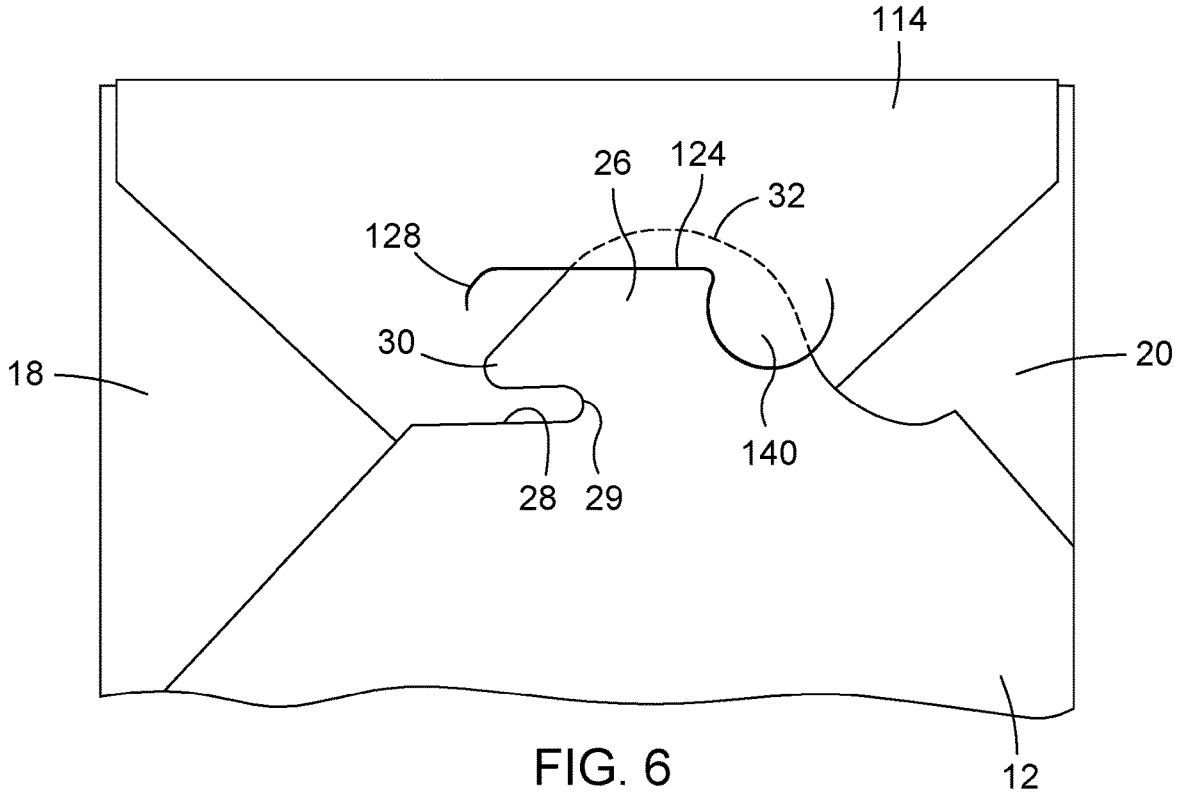
FIG. 6 shows a configuration of a second condition of how an embodiment of a locking structure of the invention may operate.

Referring to FIG. 6, in use, the lower flap 12 is moved upwardly towards the upper flap 114. In this view, the upper extremity 32 of the securement structure 26 has been moved inside the slot 124 so that it is not ordinarily visible in this view, and hence is shown in dashed line—to indicate a hidden line—for clarity of understanding. (The same use of a dashed line is used in FIGS. 7-10 to show the structure of the securement structure inside the upper flap, which would otherwise not be visible in those views.) The overall horizontal width of the slot 124 from its left end point to its right end point (distances "B," plus "A," plus "C") is large enough for the securement structure 26 to be easily slipped upward into and through the slot 124, as shown in FIGS. 6-8.

Figure 7:
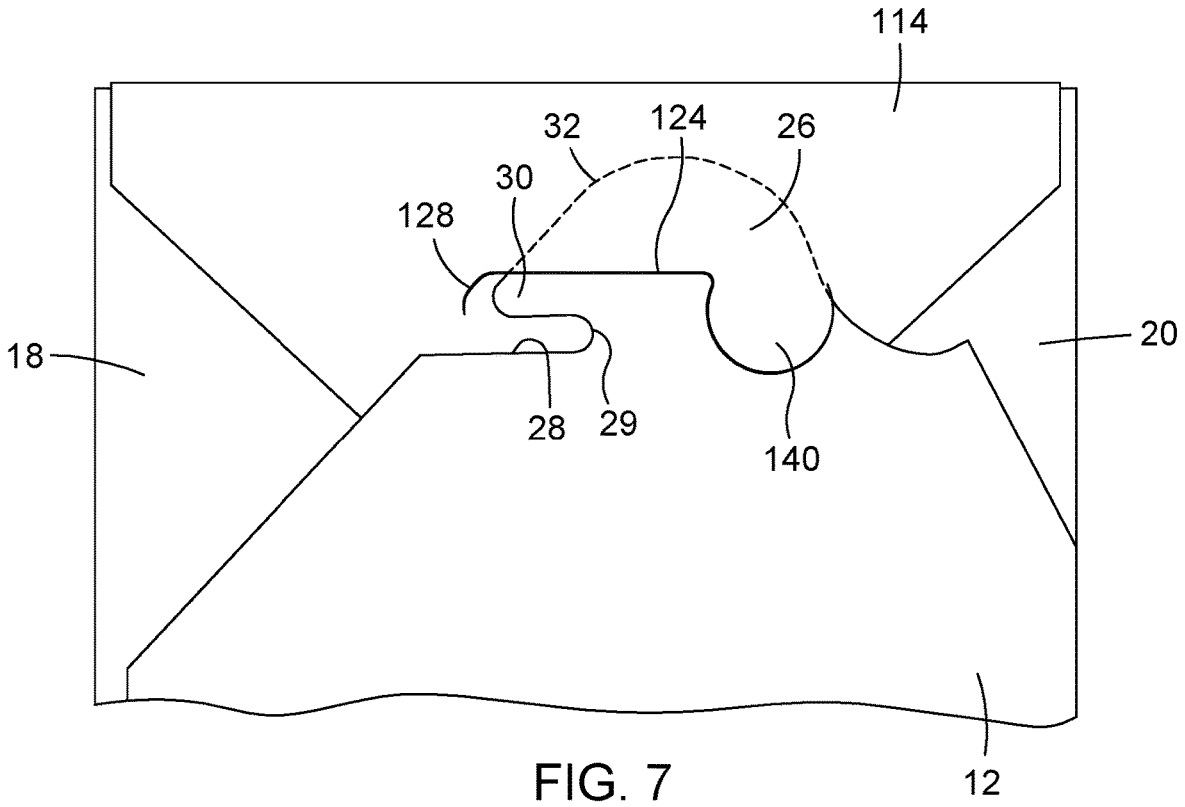
FIG. 7 shows a configuration of a third condition of how an embodiment of a locking structure of the invention may operate.

Then, referring to FIG. 7, the figure shows the lower flap 12 has been moved even closer to the upper flap 114 than in FIG. 6. The gap 28 of the lower flap is about to be engaged with the left end portion 128 of the slot 124.

Figure 8:
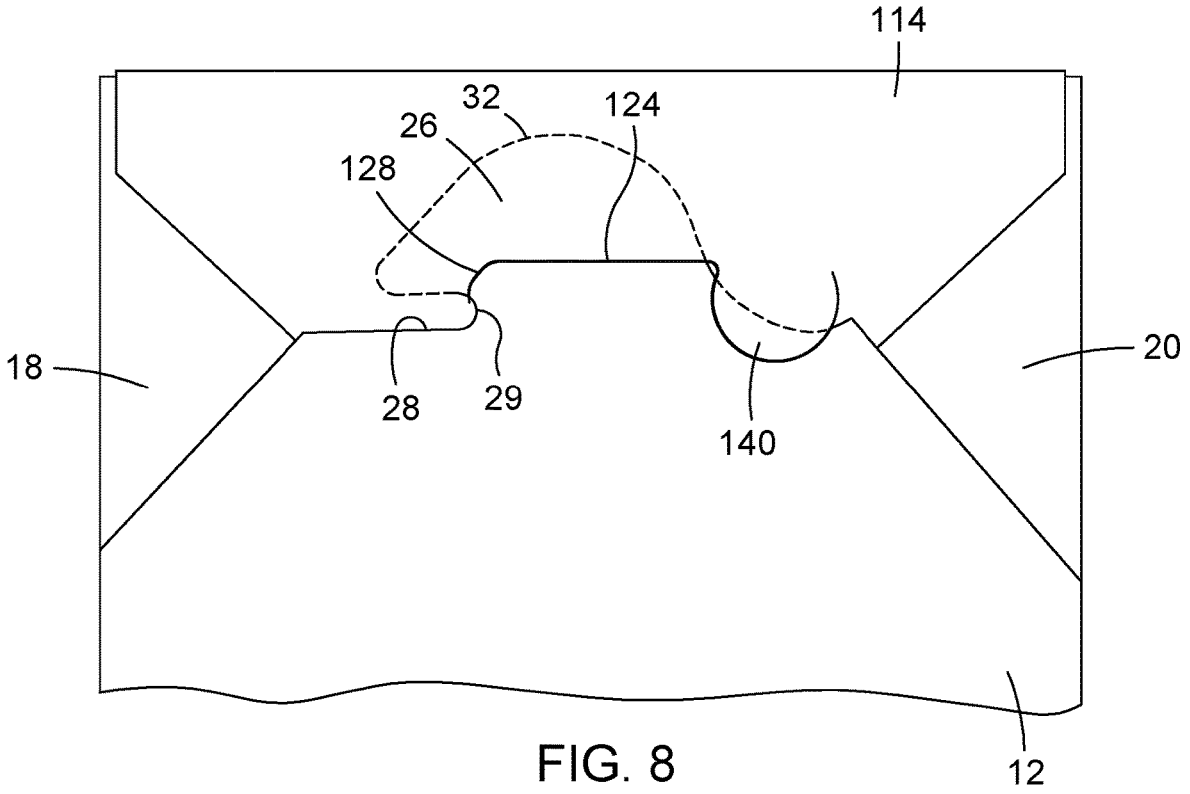
FIG. 8 shows a configuration of a fourth condition of how an embodiment of a locking structure of the invention may operate.

Then, referring to FIG. 8, the figure shows the lower flap 12 in fuller engagement with the upper flap 114. The vertical edge 29 of the gap 28 is in opposing engagement with the vertical edge 128 of the slot 124. It will be appreciated that, in this condition, the lower flap 12 can not be moved leftwards in relation to the upper flap 114, and nor can the lower flap 12 be moved vertically downwards in relation to the upper flap 114. However, it is still possible in this condition to move the lower flap 12 rightwards in relation to the upper flap 114 followed by downwards in relation to the upper flap—with the result that the lower flap can be inadvertently disengaged from the upper flap.

In use of the locking tab.

Figure 9:
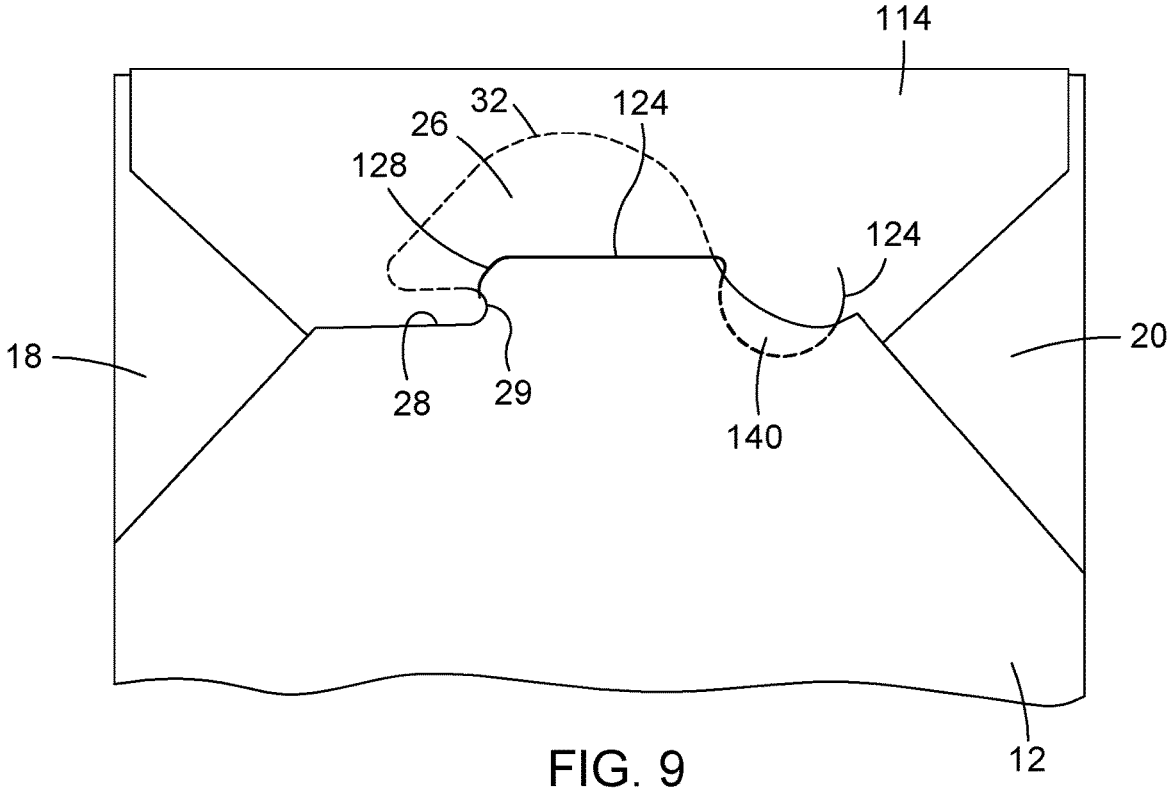
FIG. 9 shows a configuration of a fifth condition of how an embodiment of a locking structure of the invention may operate.

In order to finally secure the two flaps 12, 114 together in a novel locked condition, the structure of the tab 140 is utilized as follows after the user has inserted the securing structure 26 inside the slot 124, as described above, and as shown in FIG. 8. Then, the user pushes the tab 140 inwardly (that is, through the plane of the sheet of paper, toward the interior of the box) until the edge of the tab 140 deforms, the outline of the securing structure 26 deforms, and the box deforms slightly, to allow the tab 140 to push past the outline of the lower flap 12 until the tab 140 is positioned on the inside of the lower flap 12, as shown in FIG. 9. (Here, the use of dashed line is additionally used to show the edge of the tab 140 positioned inside the lower flap 12.) In this condition, the securing structure 26 is prevented by the left end portion 128 of the slot 124 from moving leftward, and further, the securing structure is prevented by the tab 140 from moving rightward. The securing structure 26 is also prevented from moving downwardly by the fingers 30 of the securing structure; it is also prevented from moving upwardly by the fact that the gap 28 cannot move upwardly while the upper flap 114 is situated inside the gap 28. In short, the upper flap 114 and the lower flap 12 are in a locked condition in relation to each other, unable to move up, down, left, or right, in relation to each other.

This is a novel and useful condition because, once engaged, it allows the user of the box to move the box about while filled with food or the like, without undue concern that the upper flap 114 and lower flap 12 will become disengaged from each other.

Removal of lock.

When the consumer of the contents of the box wishes to unlock the described embodiment of the box, it may be necessary to slip a finger between the lower flap 12 and the tab 140 and simply pull outwards. This may have the result of tearing the material of the box, in which case the box will have tamper evident qualities; or, the result may be that the components simply come apart after flexible distortion. Either way, the locking mechanism in the described embodiment serves its purpose, which is to prevent the box from accidentally opening during transport and while full of food or similar. The amount of force needed to open the box is far greater than in the secured condition of the prior art configuration (FIGS. 1-4), and serves to prevent accidental openings.

Figure 10:
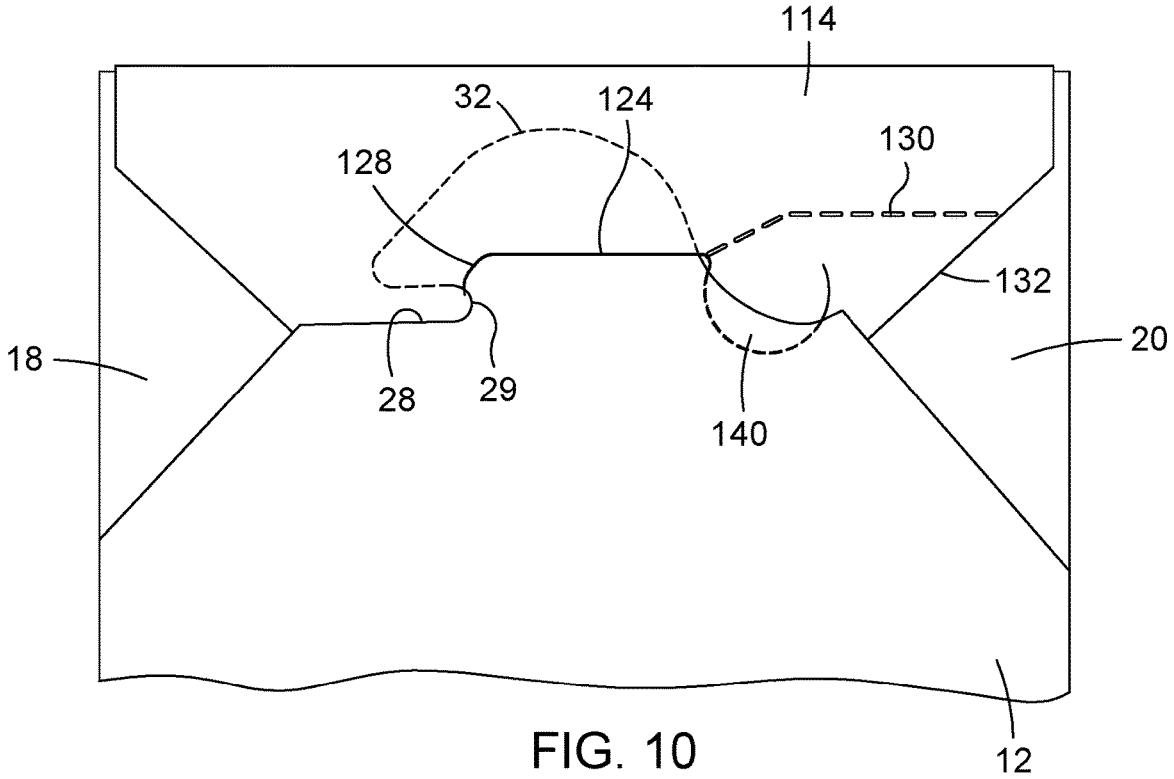
FIG. 10 shows a further embodiment of a locking structure of the invention.

However, in a further embodiment, exemplified in FIG. 10, a further feature may be added to facilitate unlocking the box from its locked condition. In this embodiment, a perforation 130 may be cut into the upper flap 114, starting at a point adjacent the slot 124, and extending horizontally until it comes to a right side edge 132 of the upper flap 114. Thus, when the box is in its locked condition as shown in FIG. 10, a user may simply grasp the right side edge 132 of the upper flap 114, and pull it outwardly (toward the user) to tear away through the perforation all the way to the slot 124. This will allow the user in one movement to disable the tab 140 from providing its locking function and the user may freely access the contents of the box.

The preceding description has been presented only to illustrate and describe examples of the principles described. This description is not intended to be exhaustive or to limit these principles in any precise form disclosed. Many modifications and variations are possible in light of the above teaching. For example, it will be appreciated that the orientation used to describe the characteristics of a single embodiment of the invention may be reversed from left to right, up to down, and will still fall within the scope of the invention, which is set forth in the claims.

I claim:

1. A lockable container comprising:

a receptacle;

an upper flap flexibly connected to the receptacle by a first hinge;

a lower flap flexibly connected to the receptacle by a second hinge;

wherein, the upper flap defines a slot that is shaped to include:

a generally horizontally extending portion of the slot having a left closed end of the slot and a right closed end of the slot;

a tab that is cantilevered and formed at the right closed end of the slot, the tab extending downwardly and configured to be flexibly moveable inwardly toward an interior of the receptacle and, alternatively, outwardly toward an exterior of the receptacle, wherein, the lower flap defines a securing structure that is sized to be inserted into the slot, the securing structure having a generally horizontally extending gap, the gap having a left open end and a right closed end, the right closed end of the gap being configured to opposingly engage with the left closed end of the slot when the securing structure is inserted into the slot, whereby giving rise to a configuration wherein, adjacent to and above the gap, the upper flap is positioned outside of the lower flap;

adjacent to and below the gap, the upper flap is positioned inside of the lower flap; and the tab is flexibly moveable between a first position in which the tab is outside of the lower flap, and a second position in which the tab is inside of the lower flap, whereby when the tab is moved into the second position the securing structure is prevented from moving leftward by the left closed end of the slot and the securing structure is simultaneously prevented from moving rightward by the tab; and further wherein a perforation is formed in the upper flap, the perforation extending from the slot to an edge of the upper flap, whereby the tab may be removed from the upper flap by tearing along the perforation.

2. The container of claim 1, wherein the tab is configured in relation to the lower flap to be flexibly moveable from the first position to the second position by a force applied to the tab in a direction toward the interior of the receptacle.

* * * * *